US006003204A

United States Patent [19]

Roach et al.

[11] Patent Number: 6,003,204

[45] Date of Patent: Dec. 21, 1999

[54] HOOD HINGE MECHANISM

[75] Inventors: James Edward Roach, West Bend; Ronald James Baker, Horicon; Ronald Ervin Brunner, Elroy, all of Wis.

[73] Assignee: Deere & Company, Moline, Ill.

[21] Appl. No.: 09/123,153

[22] Filed: Jul. 27, 1998

[51] Int. Cl.[6] ..... E05D 7/10

[52] U.S. Cl. ..... 16/267; 16/266; 16/386; 16/374; 180/69.21

[58] Field of Search ..... 16/266, 267, 268, 16/286, 288, 289, 363, 374, 386; 180/69.24, 69.21, 69.2

[56] References Cited

U.S. PATENT DOCUMENTS

| | | | |
|---|---|---|---|
| 2,706,829 | 4/1955 | Charnin | 16/374 |
| 3,471,874 | 10/1969 | Dixon | 16/267 |
| 4,223,421 | 9/1980 | Wassenaar | 16/267 |
| 4,704,604 | 11/1987 | Fuhs | 16/267 |
| 4,856,137 | 8/1989 | Palu | 16/267 |
| 5,048,154 | 9/1991 | Swartzendruber | 16/267 |
| 5,136,752 | 8/1992 | Bening et al. | 16/287 |
| 5,455,987 | 10/1995 | Svehaug | 16/267 |
| 5,645,133 | 7/1997 | Thompson et al. | 180/69.21 |

OTHER PUBLICATIONS

Parts Catalog entitled "325 and 345 Lawn & Garden Tractors", pp. F8 and F9, published by Deere & Company in the U.S.A. in Sep. 1995.

Two photographs of a tailgate pivot mechanism of a model year 1995 Ford F150 pickup truck, taken by James Roach in Jul. 1999.

*Primary Examiner*—Chuck Y. Mah

[57] ABSTRACT

A hood hinge mechanism having a pivot pin having a D-shaped cross sectional shape positioned within a recess. The hood and pin are pivotal to a position whereat the D-shaped cross section is oriented to pass through a slotted opening to the recess to thereby allow the hood to be removed or installed on the vehicle. A bracket coupled with the hood abuts a support member when the hood is pivoted to its fully open position such that the hood is held open by the weight of the hood and is generally blocked from being detached from the vehicle unless acted upon by an operator.

14 Claims, 2 Drawing Sheets

18
22
24
26
28
30
32
34
36
38
40
42
44
46
20
12

HOOD HINGE MECHANISM

BACKGROUND OF THE INVENTION

The present invention relates to mechanisms that pivotally mount a hood to a vehicle such as a lawn and garden tractor.

It is known to provide lawn and garden tractors with hoods which serve to generally enclose the vehicle engine compartment. The hoods are mounted to the vehicle frame for pivoting between open and closed positions. In the closed position the hood generally encloses the engine and other vehicle components during vehicle operation. In the open position such a hood exposes the engine and other vehicle components to allow easy access for maintenance operations. The hoods are also typically adapted for being removed entirely from the vehicle to allow even greater access to the engine and vehicle components.

One type of conventional hood mounting mechanism includes a pivot pin mounted with the hood. The pivot pin is received within an opening defined by the vehicle frame or other structural element. The pin pivots within the opening as the hood pivots between its various positions. The pin is held in place within the opening by parts such as quick pull pins, or other attaching mechanisms such as nuts and washers. To remove the hood from the vehicle an operator must partially disassemble the mechanism and remove the attaching mechanisms from the pins. This typically requires the use of tools. This type of hood hinge mechanism tends to include a relatively large number of parts, and the steps of assembly and disassembly that are required by the operator to attach or remove the hood from the vehicle tend to be undesirably complicated and time consuming.

It is known to provide hood hinge mechanisms that do not require the use of tools. Such mechanisms include those shown in U.S. Pat. Nos. 5,048,154 and 5,645,133, both of which are also assigned to Deere & Company. Those devices are relatively simple to use and are relatively simple in construction which allows them to be manufactured and assembled relatively cost effectively. However, it would be desirable to improve upon the simplicity of these structures such that the manufacturing and assembly costs are further reduced while also maintaining or improving upon the ease of operation.

It would therefore be desirable to provide a hood hinge mechanism adapted for use with a lawn and garden tractor that allows the hood to pivot smoothly between various open and closed positions, and that can be removed from the vehicle completely without requiring the use of tools, and without requiring partial disassembly of the mechanism. It would be desirable for such a mechanism to allow the removal of the hood to be a relatively simple operation. It would be desirable for such a mechanism to allow the hood to easily and smoothly pivot to its various positions without causing the hood to be detached from the vehicle accidentally. It would also be desirable for such a hood hinge to allow the hood to assume a fully open position whereat the hood remains open under its own weight, and that does not allow the hood to become easily detached from the vehicle unless acted upon by an operator. It would also be desirable for such a mechanism to be comprised of relatively few parts that can be manufactured and assembled quickly at relatively low cost.

SUMMARY OF THE INVENTION

According to the present invention, a hood hinge mechanism is provided that allows a lawn and garden tractor hood to be pivoted between closed and open positions. In the closed position the hood generally encloses a compartment which houses an engine and other vehicle component. With the hood in the open position the engine and components are generally exposed to allow access for service and maintenance. The present invention also allows the hood to be completely removed from the vehicle for providing even greater access to the engine and vehicle components within the engine compartment. The present invention includes a pin member fixed with a bracket within the interior of the hood. The pin member is received by a recess defined by a support member fixed with the vehicle frame. An opening is defined in the support member which allows the pin member to be inserted and removed from the recess when the pin member and hood are pivoted to the proper position. The pin member includes a D-shaped cross section that includes a semi-circular shaped portion and a flatted portion. The D-shaped portion is positioned within the recess. This portion of the pin member is slightly smaller than the inner diameter of the recess, and therefore the pin member pivots smoothly in abutment with the inner diameter of the recess and about the central axis of the recess. When the hood is in the closed or first position the semi-circular portion of the pin member is adjacent the opening. Since the semicircular portion has a diameter or dimension that is larger than the opening, the pin member is prevented or blocked from coming out of the recess through the opening. When the hood is pivoted to the open or second position an abutment portion of the bracket abuts against the support member for limiting the pivotal movement of the hood in that direction. In the open position the pin member is resting in a curved lower portion of the recess, and a lower lip defined by the support member blocks the pin from shifting out of the recess through the opening. The position of the center of gravity of the hood in the open position generally serves to keep the hood open. The weight of the hood, the abutment of the bracket against the support member, and the interference between the pin member and the lower lip portion prevent or block the pin member from easily shifting out of the recess through the opening when in the open position without being further acted on by an operator. To remove the hood from the vehicle the operator can pivot the hood and pin member back toward the first position from the second position until the third position is reached. In this position the pin is oriented such that the flatted portion is generally aligned with the opening. The dimension of the pin perpendicular to the flatted portion is smaller than the size of the opening, and therefore when the pin is pivotally oriented in the third position the pin is able to pass through the opening for removal of the pin from the recess. In the third position the bracket has pivoted a short distance from abutment with the support member, which provides clearance for the hood and pin member to be lifted such that the pin can pass over the lower lip portion of the support member for pulling the pin member out of the recess through the opening. The curved inner diameter of the recess facilitates easy lifting of the pin over the lower lip.

The present invention therefore provides a hood hinge mechanism that is relatively easy to operate and that can be removed from the vehicle without partially disassembling the hinge mechanism. The present invention is simple in construction and comprised of relatively few parts such that the cost of manufacture and assembly is reduced. Removal of the hood according to the present invention is a relatively simple operation. The hood hinge according to the present invention allows the hood to easily and smoothly pivot to its various positions while preventing the hood from being detached from the vehicle. The present invention allows the hood to assume a fully open position whereat the hood remains open under its own weight, and does not allow the hood to become easily detached from the vehicle unless acted upon by an operator.

DESCRIPTION OF THE PREFERRED EMBODIMENT

Figure 1:
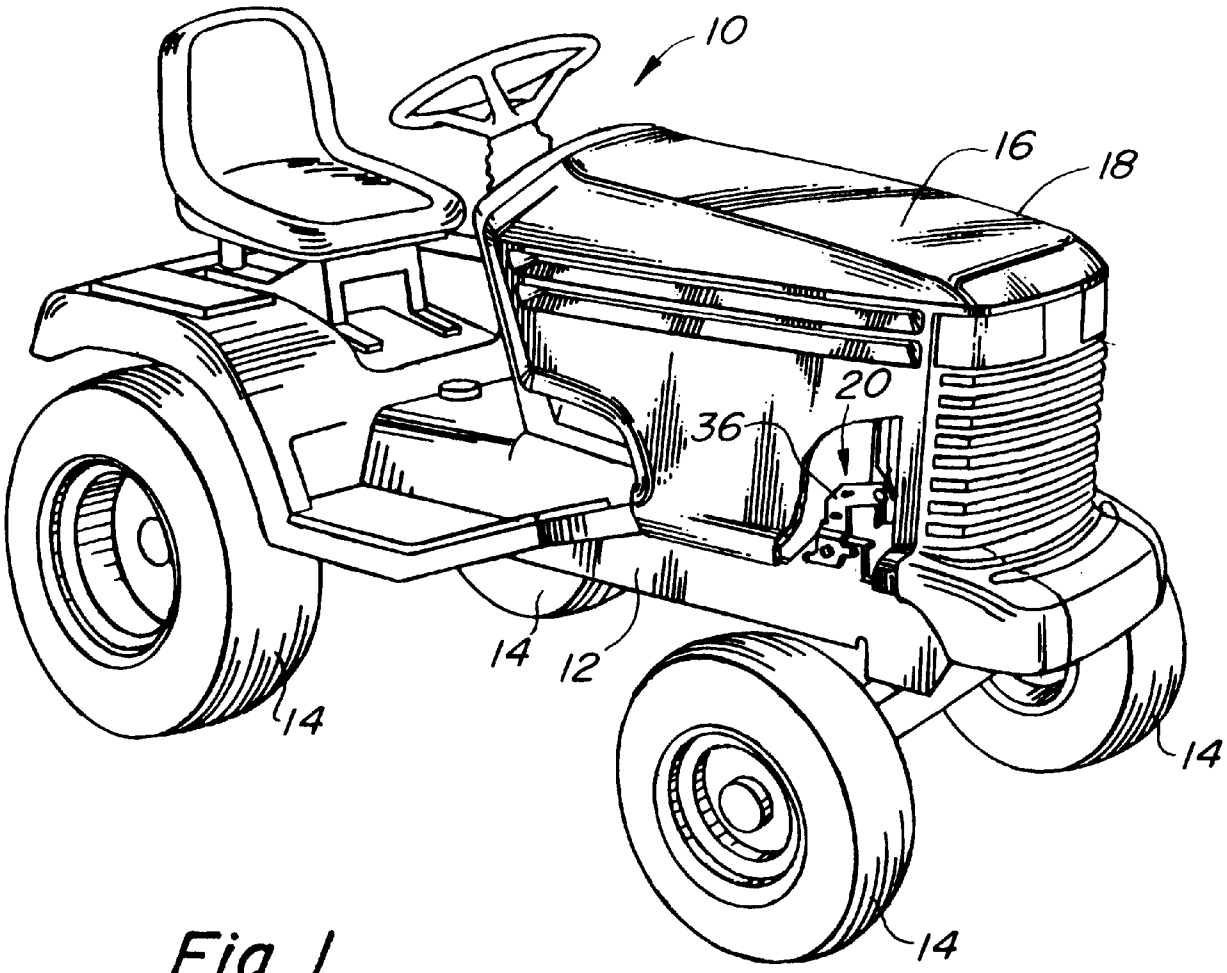
FIG. 1 is a perspective cut-away view of a lawn and garden tractor having a hood mounted to the vehicle frame by way of the hood hinge mechanism according to the present invention.

Referring now to FIGS. 1–4, there is shown the preferred embodiment of the present invention. FIG. 1 shows a vehicle or lawn tractor 10 with which the present invention is adapted for use. The vehicle 10 includes a frame 12 and ground engaging wheels 14. The vehicle 10 includes an engine (not shown) that drives the ground engaging wheels 14 and other vehicle implements such as a mower deck or a snow thrower. The engine is positioned within an engine compartment 16. A compartment enclosure or hood 18 is coupled with the vehicle 10 for generally enclosing the engine and other vehicle components. The hood 18 can be pivoted upwardly and forwardly to an open position, and can also be removed from the vehicle 10 entirely, as will be described in more detail below.

Figures 2, 3, 4:
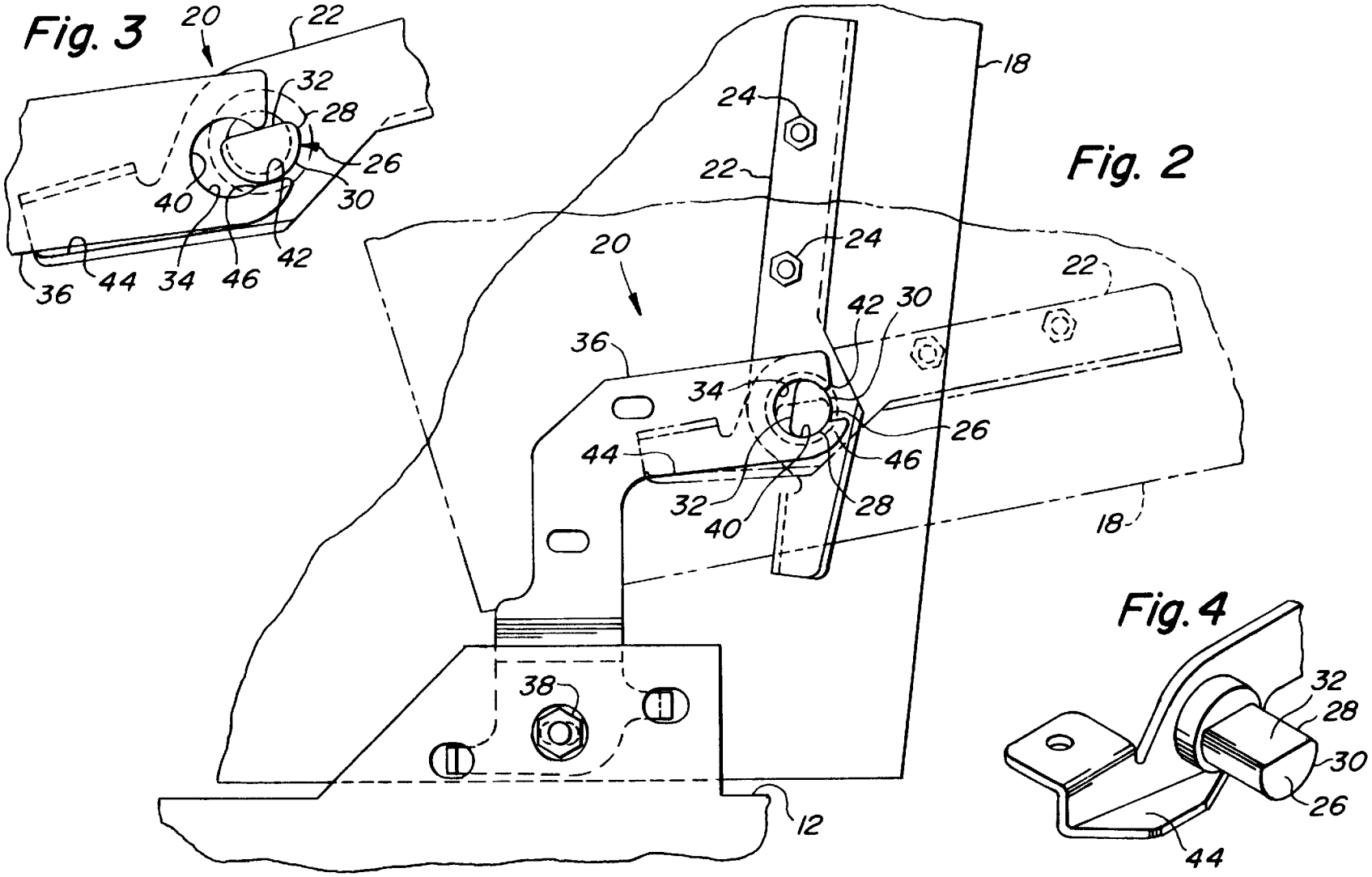
FIG. 2 is a partial side view of the hood hinge according to the present invention showing the hinge mechanism and hood in the closed position in solid lines and in the fully open position in broken lines.
FIG. 3 is a side view of the hood hinge according to the present invention with the pin member passing through the slotted opening to the recess.
FIG. 4 is a perspective view of the pin member coupled with the bracket of the hood hinge according to the present invention.

Referring now to FIGS. 2–4, there is shown a hood hinge mechanism 20 according to the present invention. A pair of hinge mechanisms 20 are provided at the lower front portions of the interior of hood 18, the front right hinge mechanism 20 being shown in FIG. 1. The hinge mechanism 20 includes a bracket or abutment member 22 that is rigidly fixed as by bolts 24 to the interior of the hood 20. A pin member 26 is rigidly fixed as by cold forming, swedging, or welding to the bracket 22, as best seen in FIG. 4. The pin members 26 extend laterally inwardly toward the centerline of the vehicle 10, and include a D-shaped cross sectional shape 28. The D-shape 28 is defined by a semicircular portion 30 and a flatted portion 32. The D-shaped portion 28 of the pin member 26 is held within a recess 34 formed in a support member 36 fixed as by bolts 38 to the frame 12. The support member 36 generally supports the pin member 26 and therefore at least a portion of the weight of the hood 18 during operation of the vehicle 10. The recess 34 has a semicircular shape having a diameter that is only slightly larger than the diameter of the semicircular portion 30 of the pin member 26. This allows the pin member 26 to pivot within the recess 34 about the central axis of the recess 34 and in close abutment with the inner diameter 40 of the recess 34 as the hood 18 is pivoted to its various positions.

The support member 36 defines an opening 42 to the recess 34. When oriented properly, the pin member 26 can pass through the opening 42 to remove the pin member 26 from the recess 34 for removal of the hood 18 from the vehicle 10. To install the hood 18 on the vehicle 10 the pin member 26 can be properly oriented to allow the pin member 26 to pass through the opening 42 for insertion of the pin member 26 into the recess 34 during installation of the hood 18, as will be described in greater detail below.

Next, the operation of the hinge mechanism 20 according to the present invention will be described in greater detail. When the hood 18 is in a closed or first position as shown in FIG. 1, the hood hinge mechanism 20 is oriented as shown in solid lines in FIG. 2. The D-shaped portion 28 of the pin member 26 is positioned within the recess 34. The curved or semicircular portion 30 of the pin member 26 is positioned adjacent the opening 42. The opening 42 is smaller than the diameter of the semicircular portion 30 of the pin member 26, and therefore the pin member 26 can not pass through the opening 42 when oriented as shown in solid lines in FIG. 2. Therefore, when the hood 18 is in its closed or first position, the pin member 26 is securely confined within the recess 34 since the semicircular portion 30 of the pin member 26 is too large to pass through the opening 42 when the pin member 26 is oriented in the first position.

An operator can open the hood 18 to a second position whereat the contents of the engine compartment 16 are generally exposed for maintenance. To open the hood 18 the operator pivots the hood 18 upwardly and forwardly from the position shown in solid lines in FIG. 2 to the position shown in broken lines in FIG. 2. As the hood 18 pivots upwardly toward the second position, the outer edges of the semicircular portion 30 of the pin member 26 ride on or abut the inner diameter 40 of the recess 34. The pin member 26 smoothly pivots within the recess 34 until the fully opened position is achieved, as is shown in broken lines in FIG. 2. In this fully open or second position, an abutment portion 44 of the bracket member 22 abuts the underside of the support member 36. This abutment or interference of the bracket 22 against the support member 36 blocks the bracket 22, pin member 26 and hood 18 from pivoting further in that direction. The center of gravity of the hood 18 in the second position is located forward of the pin member 26 and recess 34, and therefore the weight of the hood 18 causes the hood 18 to remain stationary in the open position.

In the second or fully open position the pin member 26 is supported by the curved inner diameter 40 of the recess 34. In the second position the pin member 26 is blocked or prevented from shifting forwardly through the opening 42 by the presence of the lower lip portion 46 of the support member 36 that defines the forward lower portion of the recess 34. The pin member 26 would have to be pivoted slightly from the second position and then lifted over this lip portion 46 of the support member 36 in order for the pin member 26 to pass through the opening 42. The weight of the hood 18 and the abutment of the bracket 22 against the underside of the support member 36 generally prevent this from happening. Therefore the pin member 26 and hood 18 remain in the fully open position and are generally hindered from becoming detached from the vehicle 10 unless acted upon by an operator.

As stated above, the hood 18 can be completely removed from the vehicle 10 by an operator to provide greater access and clearance to the engine and other vehicle components located within the engine compartment 16. To remove the hood 18 from the vehicle 10, the operator pivots the hood 18 slightly from the second or fully open position toward the first or closed position until the third position is reached. In the third position, the abutment portion 44 of the bracket 22 pivots away from the support member 36, which provides clearance for the pin member 26 to be lifted over the lower lip portion 46 of the support member 36. From the third position, the operator can lift the pin member 26 slightly upwardly over the lower lip portion 46 of the support member 36 to the position shown in FIG. 3, and can pull the pin member 26 forwardly out of the recess 34 through the opening 42, thereby removing the hood 18 from the vehicle 10. The curved inner diameter of the lower portion of the recess allows an operator to easily slide the pin member 26 upwardly over the lower lip 46 once the pin member 26 has been pivoted to the third position. This facilitates easy removal of the hood 18 from the vehicle 10.

To re-install the hood 18 to the vehicle 10, the operator orients the pin member 26 so that it can pass through the opening 42. The operator then manipulates the hood 18 until the pin member 26 passes into the recess 34 via the opening 42. Once the pin member 26 is again positioned within the recess 34, the operator can either pivot the hood 18 to the fully open position, or pivot the hood 18 to the closed position.

What is claimed is:

1. A mechanism comprising:

a vehicle having a compartment and a compartment enclosure the enclosure having three pivoted positions, a first position whereat the enclosure is positioned to cover the compartment, a second position whereat the enclosure is fully opened, and a third position whereat the enclosure is pivoted slightly toward the first position from the second position, a hinge mechanism coupled between the enclosure and the vehicle and being oriented to allow pivotal motion of the enclosure between the first, second and third positions and removal of the enclosure from the vehicle in the third position, said hinge mechanism comprising a support structure carried by the vehicle, said support structure includes a semicircular recess and an opening to the recess, said hinge mechanism further comprising a pin member coupled with the enclosure and pivotably received within the recess, said pin member having a semicircular cross sectional shape that includes a flatted portion, said pin member having a diameter that is larger than the opening such that the diameter of the pin member blocks the pin member from shifting out of the recess through the opening when the enclosure is in the first position, and the pin member has a dimension perpendicular to the flatted portion that is smaller than the opening such that the dimension of the pin member perpendicular to the flatted portion will fit through the opening when the enclosure is in the third position for removal of the enclosure from the vehicle, wherein to remove the enclosure from the vehicle the enclosure is pivoted toward the first position from the second position until the third position is reached, at which time clearance is provided for the enclosure and pin member to be lifted up and out of the recess through the opening, wherein an inner diameter of the recess is only slightly larger than an outer diameter of the pin member such that the pin member pivots about a central axis of the recess and with the semicircular shape of the pin member in close abutment with the inner diameter of the recess as the enclosure pivots between the first, second and third positions, and wherein the semicircular shape and the flatted portion of the pin member define a D-shaped cross section of the pin member.

2. The invention of claim 1, wherein said enclosure is a hood for an engine compartment.

3. The invention of claim 1, wherein in the first position the pin member is oriented with the semi-circular shape adjacent the opening for blocking the pin member from shifting out of the recess through the opening, and in the third position the flatted portion is aligned with and adjacent the opening for allowing the pin member to pass through the opening.

4. The invention of claim 1, and further comprising an abutment member coupled for pivoting with the enclosure, said abutment member being adapted to abut the support structure when the enclosure is in the second position for limiting pivotal movement of the enclosure.

5. The invention of claim 4, wherein in the second position the semicircular shape of the pin member is resting in the semi-circular shape of the recess and the abutment member is abutting the support member, and the semi-circular shape of the recess blocks the pin member from shifting linearly through the opening when in the second position.

6. The invention of claim 4, wherein said abutment member is a bracket fixed with the enclosure and the pin member is coupled to the bracket.

7. A mechanism comprising:

a vehicle having a compartment and a compartment enclosure, the enclosure having three pivoted positions, a first position whereat the enclosure is positioned to cover the compartment, a second position whereat the enclosure is fully opened, and a third position whereat the enclosure is pivoted slightly toward the first position from the second position, the enclosure and hinge mechanism being oriented to remove the enclosure from the vehicle in the third position, a hinge mechanism coupled between the vehicle and the enclosure, said hinge mechanism comprising a support structure carried by the vehicle, said support structure includes a semicircular recess and an opening to the recess, said hinge mechanism further comprising a pin member coupled with the enclosure and pivotably received within the recess, said pin member having a D-shaped cross section having a semicircular shape and a flatted portion, said pin member having a diameter that is larger than the opening such that the diameter of the semicircular shape of the pin member blocks the pin member from shifting out of the recess through the opening when the enclosure is in the first position, and the pin member has a dimension perpendicular to the flatted portion that is smaller than the opening such that the dimension of the pin member perpendicular to the flatted portion will fit through the opening when the enclosure is in the third position for removal of the enclosure from the vehicle, wherein an inner diameter of the recess is only slightly larger than an outer diameter of the pin member, such that the pin member pivots about a central axis of the recess and with the semicircular shape of the pin member in close abutment with an inner diameter of the recess as the enclosure pivots between the first, second and third positions, and wherein in the first position the pin member is oriented with the semi-circular shape adjacent the opening for blocking the pin member from shifting out of the recess through the opening, and in the third position the flatted portion is aligned with and adjacent the opening for allowing the pin member to pass through the opening, wherein to remove the enclosure from the vehicle the enclosure is pivoted toward the first position from the second position until the third position is reached, at which time clearance is provided for the enclosure and pin member to be lifted up and out of the recess through the opening.

8. The invention of claim 7, wherein in the second position the semicircular shape of the pin member is resting in the semi-circular shape of the recess and the semi-circular shape of the recess blocks the pin member from shifting linearly through the opening when in the second position.

9. The invention of claim 8, and further comprising an abutment member coupled with the enclosure, said abutment member being adapted to abut the support structure when the enclosure is in the second position for limiting travel of the enclosure.

10. The invention of claim 9, wherein said abutment member is a bracket fixed with the enclosure and the pin member is fixed with the bracket.

11. The invention of claim 10, wherein said enclosure is a hood for an engine compartment.

12. The invention of claim 7, and further comprising an abutment member coupled with the enclosure, said abutment member being adapted to abut the support structure when the enclosure is in the second position for limiting travel of the enclosure.

13. The invention of claim 12, wherein said abutment member is a bracket fixed with the enclosure and the pin member is fixed with the bracket.

14. The invention of claim 7, wherein said enclosure is a hood for an engine compartment.

* * * * *